US005124224A

United States Patent [19]

Berkes et al.

[11] Patent Number: 5,124,224

[45] Date of Patent: Jun. 23, 1992

[54] TONER COMPOSITIONS AND PROCESSES WITH POLYETHYLENES INCLUDING A LINEAR CRYSTALLINE POLYETHYLENE

[75] Inventors: John S. Berkes; Paul C. Julien; Suresh K. Ahuja, all of Webster; Che C. Chow, Penfield, all of N.Y.

[73] Assignee: Xerox Corporation, Stamford, Conn.

[21] Appl. No.: 679,507

[22] Filed: Apr. 1, 1991

[51] Int. Cl.[5] ..... G03G 9/08

[52] U.S. Cl. ..... 430/110; 430/109; 430/137

[58] Field of Search ..... 430/110, 109, 137

[56] References Cited

U.S. PATENT DOCUMENTS 3,590,000 6/1971 Palermiti et al. ..... 252/62.1
3,983,045 9/1976 Jugle et al. ..... 252/62.1 P
4,367,275 1/1983 Aoki et al. ..... 430/99
4,912,010 3/1990 Mori et al. ..... 430/109
4,952,477 8/1990 Fuller et al. ..... 430/109

FOREIGN PATENT DOCUMENTS 1442835 10/1972 United Kingdom .

*Primary Examiner*—Marion E. McCamish
*Assistant Examiner*—S. Rosasco
*Attorney, Agent, or Firm*—E. O. Palazzo

[57] ABSTRACT

A process for the preparation of a toner with a melting point of from about 100° to about 130° C. which comprises the addition of a linear crystalline polyethylene with a weight average molecular weight of from about 500 to about 1,200 to a toner comprised of a polyester and pigment.

16 Claims, No Drawings

TONER COMPOSITIONS AND PROCESSES WITH POLYETHYLENES INCLUDING A LINEAR CRYSTALLINE POLYETHYLENE

BACKGROUND OF THE INVENTION

This invention is generally directed to toner and developer compositions, and more specifically the present invention is directed to toner compositions, including magnetic, single component, and colored toner compositions with polyethylenes. In one embodiment of the present invention, the toner compositions are comprised of polyester resin particles, reference U.S. Pat. No. 3,590,000, the disclosure of which is totally incorporated herein by reference, pigment particles, and certain crystalline polyethylenes, especially those with a weight average molecular weight of from about 500 to about 1,200, and preferably 1,000. Also, the present invention is directed to processes for providing low melt, from about 100° C. to about 130° C., roll fusible toners by adding thereto certain crystalline olefins, such as polyethylenes, and wherein the toner resin is comprised of a linear polyester. In one embodiment, there is incorporated into the linear polyester as a second incompatible phase an effective amount, for example from about 1 to about 10 weight percent, of the crystalline polyethylene. During roll fusing in an electrophotographic, especially a xerographic, imaging apparatus, such as the Xerox Corporation 5090®, the molecular weight of the polyethylene can be selected to enable the melting thereof prior to any substantial fusing of the toner resin; thus, in this embodiment the polyethylene is in the liquid form prior to the melting of the toner resin, and it can migrate to the toner/fuser interface and provide fuser latitude for hot offsetting. Offsetting can occur when the toner particles are substantially retained, or are not fully released from the toner transporting means or roll; and fusing lattitude can be referred to as the temperature range between the minimum fix and hot offset toner temperature. Thus, for example, with the processes of the present invention the amount of fuser release oil selected can be reduced to, for example, 2 microliters per copy from 20 to about 50 microliters per copy. With the toners and processes of the present invention, the fuser temperature can be reduced by as much as 45° C. while achieving an excellent latitude in embodiments thereof. The linear polyethylenes selected for the present invention preferably have a number average molecular weight of less than about 1,500 and melt below about 125° C., which polyethylenes are available from Petrolite Corporation as, for example, POLYWAX 1,000 TM, POLYWAX 655 TM and POLYWAX 500 TM with a weight average molecular weight of from about 500 to about 1,500, and preferably about 1,000. Known toner resins, such as styrene methacrylates, styrene acrylates, styrene butadienes, and the like can also be added to the toner compositions of the present invention to assist in increasing toner elasticity. Moreover, the toner and developer compositions of the present invention enable the photoconductive imaging member present in an imaging apparatus to function for extended time periods, for example up to 75,000 cycles, while simultaneously preventing the localized accumulation of undesirable toner debris thereon which can encompass sufficient areas of the photoconductive members to permit unwanted toner spots to be present on the final developed output copy. Further, the developer compositions of the present invention possess stable electrical properties for extended time periods, and with these compositions, for example, there is no substantial change in the triboelectrical charging.

Developer and toner compositions with certain waxes therein are known. For example, there are disclosed in U.K. Patent Publication 1,442,835 toner compositions containing resin particles, and polyalkylene compounds, such as polyethylene and polypropylene of a molecular weight of from about 1,500 to 6,000, reference page 3, lines 97 to 119, which compositions prevent toner offsetting in electrostatic imaging processes. With the toners of the present invention, there is selected a polyethylene with a molecular weight of from about 500 to about 1,200 thereby enabling enhanced release of the developed image from the fuser roll. With the presence of the aforementioned wax in the toner no, or substantially no toner offset resulted for fuser silicone oiling rates as low as 2 microliters per copy, as contrasted, for example, from about 30 to about 50 microliters per copy needed to achieve toner image release in the absence of the polyethylene component. Additionally, the '835 publication discloses the addition of paraffin waxes together with, or without a metal salt of a fatty acid, reference page 2, lines 55 to 58. In addition, many patents disclose the use of metal salts of fatty acids for incorporation into toner compositions, such as U.S. Pat. No. 3,655,374. Also, it is known that the aforementioned toner compositions with metal salts of fatty acids can be selected for electrostatic imaging methods wherein blade cleaning of the photoreceptor is accomplished, reference Palmeriti et al. U.S. Pat. No. 3,635,704, issued Jan. 18, 1972, the disclosure of which is totally incorporated herein by reference. Additionally, there are illustrated in U.S. Pat. No. 3,983,045 three component developer compositions comprising toner particles, a friction reducing material, and a finely divided nonsmearable abrasive material, reference column 4, beginning at line 31. Examples of friction reducing materials include saturated or unsaturated, substituted or unsubstituted, fatty acids preferably of from 8 to 35 carbon atoms, or metal salts of such fatty acids; fatty alcohols corresponding to said acids; mono and polyhydric alcohol esters of said acids and corresponding amides; polyethylene glycols and methoxypolyethylene glycols; terephthalic acids; and the like, reference column 7, lines 13 to 43.

Described in U.S. Pat. No. 4,367,275 are methods of preventing offsetting of electrostatic images of the toner composition to the fuser roll, which toner subsequently offsets to supporting substrates, such as papers, wherein there are selected toner compositions containing specific external lubricants including various waxes, see column 5, lines 32 to 45. Other references of interest which disclose the use of amides as toner additives include U.S. Pat. Nos. 4,072,521; 4,073,649 and 4,076,641. Furthermore, references of background interest are U.S. Pat. Nos. 3,165,420; 3,236,776; 4,145,300; 4,271,249; 4,556,624; 4,557,991 and 4,604,338.

Moreover, toner and developer compositions containing charge enhancing additives, especially additives which impart a positive charge to the toner resin, are well know. Thus, for example, there is described in U.S. Pat. No. 3,893,935 the use of certain quaternary ammonium salts as charge control agents for electrostatic toner compositions. There are also described in U.S. Pat. No. 2,986,521 reversal developer compositions comprised of toner resin particles coated with finely divided colloidal silica. According to the disclosure of this patent, the development of images on negatively charged surfaces is accomplished by applying a developer composition having a positively charged triboelectric relationship with respect to the colloidal silica. Further, there are illustrated in U.S. Pat. No. 4,338,390, the disclosure of which is totally incorporated herein by reference, developer and toner compositions having incorporated therein as charge enhancing additives organic sulfate and sulfonate compositions; and in U.S. Pat. No. 4,298,672, the disclosure of which is totally incorporated herein by reference, positively charged toner compositions containing resin particles and pigment particles, and as a charge enhancing additive alkyl pyridinium compounds, inclusive of cetyl pyridinium chloride. These and other charge additives can be incorporated into the toners of the present invention.

Other examples of prior art disclosing positively charged toner compositions with charge enhancing additives include U.S. Pat. Nos. 3,944,493; 4,007,293; 4,079,014 and 4,394,430.

SUMMARY OF THE INVENTION

It is a feature of the present invention to provide toner and developer compositions which possess many of the advantages illustrated herein.

Another feature of the present invention resides in the provision of toner and developer compositions with stable triboelectrical characteristics for extended time periods.

In another feature of the present invention there are provided low melting toner and developer compositions.

Moreover, another feature of the present invention relates to processes for enhancing the fuser roll latitude of linear polyesters by the addition thereto of certain crystalline polyethylenes. It is believed that the aforementioned latitude can be enhanced by a mechanism which involves the melting of the polyethylene, its diffusion to the toner/fuser roll interface, and the like thereby providing a release layer and enabling roll fusing with the utilization of low release oil amounts.

Another feature of the present invention resides in the provision of processes and polyester toners thereof with low melting points thereby enabling roll fusing of such toners with reduced amounts of fuser oil, such as silicone oil, that is for example less than the 20 to 50 microliters per copy presently selected for a number of commercial xerographic machines.

These and other features of the present invention can be accomplished by providing developer compositions, and toner compositions comprised of resin particles, pigment particles, and polyethylenes. More specifically, the present invention is directed to a process for enhancing the roll fusing latitude of linear polyesters by the addition thereto of certain crystalline polyethylenes. Furthermore, there are provided in accordance with the present invention processes for positively charged toner compositions comprised of polyester resin particles, pigment particles, crystalline polyethylenes, and charge, enhancing additives. Another embodiment of the present invention is directed to developer compositions comprised of the aforementioned toners, and carrier particles.

In accordance with embodiments of the present invention, there are provided processes for the preparation of toner compositions containing linear polyester resin particles by the addition thereto of crystalline polyethylenes with a melting point of less than about 125° C., and more specifically as low as 90° C., which polyethylenes are available from Petrolite Corporation as indicated herein, and which toners possess a melting point, as determined by DSC, differential scanning calorimetry, of from about 100° to about 130° C.; and adding thereto as optional components charge enhancing additives, particularly, for example, distearyl dimethyl ammonium methyl sulfate, reference U.S. Pat. No. 4,560,635, the disclosure of which is totally incorporated herein by reference, and carrier particles. As carrier components for the aforementioned compositions, there can be selected steel or ferrite materials, particularly with a polymeric coating thereover including the coatings as illustrated in U.S. Ser. No. 751,922, (abandoned) entitled Developer Composition with Specific Carrier Particles, the disclosure of which is totally incorporated herein by reference. One particularly preferred coating illustrated in the aforementioned copending application is comprised of a copolymer of vinyl chloride and trifluorochloroethylene with conductive substances dispersed in the polymeric coating inclusive of, for example, carbon black. One embodiment disclosed in the aforementioned copending application is a developer composition comprised of styrene butadiene copolymer resin particles, and charge enhancing additives selected from the group consisting of alkyl pyridinium halides, ammonium sulfates, and organic sulfate or sulfonate compositions; and carrier particles comprised of a core with a coating of vinyl copolymers, or vinyl homopolymers.

In one process embodiment, about 90 weight percent of a known linear polyester, such as propoxilated bisphenol fumerate, about 5 weight percent of a known toner pigment, such as Hostaperm Pink, about 4 weight percent of POLYWAX 1,000 TM, and 1 weight percent of charge control additive, such as distearyl dimethyl ammonium methyl sulfate, were dry blended and subsequently melt blended in an extruder with a barrel temperature of from about 80° to about 90° C., and a die temperature of about 120° C. After cooling, the extrusion toner product was micronized and classified by known means to enable toner particles with a mean average diameter of from about 8 to about 20, and preferably about 9 microns.

Illustrative examples of suitable known polyester toner resins selected for the present invention, and present in various effective amounts such as, for example, from about 70 percent by weight to about 95 percent by weight, include propoxilated bisphenol fumarate, cyclohexanol bisphenol terephthalate, propylene butylene terephthalate, other known low melting polyesters, and the like.

Numerous well known suitable pigments can be selected as the colorant for the toner particles including, for example, carbon black, such as Regal ® 330, nigrosine dye, aniline blue, phthalocyanines, magnetites and mixtures thereof. The pigment, which is preferably carbon black, is usually present in a sufficient amount to render the toner composition colored thereby permitting the formation of a suitable visible image. Generally, the pigment particles are present in amounts of from about 2 percent by weight to about 20 percent by weight, and preferably from about 5 to about 10 weight percent, based on the total weight of the toner composition, however, lesser or greater amounts of pigment particles may be selected.

When the pigment particles are comprised of magnetites, including those commercially available as Mapico Black ®, they are present in the toner composition in an amount of from about 10 percent by weight to about 70 percent by weight, and preferably in an amount of from about 10 percent by weight to about 30 percent by weight. Alternatively, there can be selected as pigment particles mixtures of carbon black or equivalent pigments and magnetites, which mixtures, for example, contain from about 6 percent to about 70 percent by weight of magnetite, and from about 2, percent to about 15 percent by weight of carbon black. Particularly preferred as pigments are magnetites as they enable, for example, images with no toner spots for extended time periods exceeding the development of 100,000 images, which corresponds to about 400,000 imaging cycles for a panel containing four imaging members.

Also embraced within the scope of the present invention are colored toner compositions containing as pigments or colorants red, green, blue, brown, magenta, cyan, and/or yellow particles, as well as mixtures thereof. More specifically, with regard to the generation of color images utilizing the toner and developer compositions of the present invention, illustrative examples of magenta materials that may be selected include, for example, 2,9-dimethyl-substituted quinacridone and anthraquinone dye identified in the Color Index as CI 60710, CI Dispersed Red 15, a diazo dye identified in the Color Index as CI 26050, CI Solvent Red 10, Lithol Scarlett, Hostaperm, and the like. Illustrative examples of cyan materials that may be used as pigments include copper tetra-4(octadecyl sulfonamido) phthalocyanine, X-copper phthalocyanine pigment listed in the Color Index as CI74160, CI Pigment Blue, and Anthrathrene Blue, identified in the Color Index as CI 69810, Special Blue X-2137, Sudan Blue, and the like; while illustrative examples of yellow pigments that may be selected include diarylide yellow 3,3-dichlorobenzidene acetoacetanilides, a monazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Permanent Yellow FGL, and the like. These pigments are generally present in the toner composition in an amount of from about 2 weight percent to about 15 weight percent based on the weight of the toner resin particles.

Illustrative examples of optional charge enhancing additives present in various effective amounts, such as, for example, from about 0.1 to about 20 percent by weight, include alkyl pyridinium halides, such as cetyl pyridinium chlorides, reference U.S. Pat. No. 4,298,672, the disclosure of which is totally incorporated herein by reference; cetyl pyridinium, tetrafluoroborates, quaternary ammonium sulfate, and sulfonate charge control agents as illustrated in U.S. Pat. No. 4,338,390, the disclosure of which is totally incorporated herein by reference; stearyl phenethyl dimethyl ammonium tosylates, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; stearyl dimethyl hydrogen ammonium tosylate; and other known similar charge enhancing additives providing the objectives of the present invention are accomplished; and the like.

Although it is not desirable to be limited by theory, it is believed that the crystalline polyethylenes selected possess a very narrow polydispersity, that is the ratio of $M_w/M_n$ is equal to or less than about 1.1 in one preferred embodiment; and moreover, these polyethylenes possess high crystallinity with a density, for example, of about 0.96 at 25° C. In addition, the crystalline polyethylenes of the present invention selected possess an appropriate hardness and toughness properties enabling the resulting toner and developer compositions to be readily attritable to fine particle sizes of less than, for example, about 20 micrometers average diameter.

Illustrative examples of carrier particles that can be selected for mixing with the toner compositions of the present invention include those particles that are capable of triboelectrically obtaining a charge of opposite polarity to that of the toner particles. Accordingly, the carrier particles of the prsent invention can be selected so as to be of a negative polarity thereby enabling the toner particles which are positively charged to adhere to and surround the carrier particles. Alternatively, there can be selected carrier particles with a positive polarity enabling toner compositions with a negative polarity. Illustrative examples of carrier particles that may be selected include granular zircon, granular silicon, glass, steel, nickel, iron, ferrites, silicon dioxide, and the like. Additionally, there can be selected as carrier particles nickel berry carriers as disclosed in U.S. Pat. No. 3,847,604, which carriers are comprised of nodular carrier beads of nickel characterized by surfaces of reoccurring recesses and protrusions thereby providing particles with a relatively large external area. Preferred carrier particles selected for the present invention are comprised of a magnetic, such as steel, core with a polymeric coating thereover, several of which are illustrated, for example, in U.S. Ser. No. 751,922 (abandoned) relating to developer compositions with certain carrier particles, the disclosure of which is totally incorporated herein by reference. More specifically, there are illustrated in the aforementioned application carrier particles comprised of a core with a coating thereover of vinyl polymers or vinyl homopolymers. Examples of specific carriers illustrated in the application, and particularly useful for the present invention are those comprised of a steel or ferrite core with a coating thereover of a vinyl chloride/trifluorochloroethylene copolymer, which coating contains therein conductive particles, such as carbon black. Other coatings include fluoropolymers, such as polyvinylidenefluoride resins, poly(chlorotrifluoroethylene), fluorinated ethylene and propylene copolymers, terpolymers of styrene, methylmethacrylate, and a silane, such as triethoxy silane, reference U.S. Pat. Nos. 3,467,634 and 3,526,533, the disclosures of which are totally incorporated herein by reference; polytetrafluoroethylene, fluorine containing polyacrylates, and polymethacrylates; copolymers of vinyl chloride; and trichlorofluoroethylene; and other known coatings. There can also be selected as carriers components comprised of a core with a double polymer coating thereover, reference U.S. Pat. Nos. 4,937,166 and 4,935,326, the disclosures of which are totally incorporated herein by reference. More specifically, there are detailed in these patents carrier particles with substantially stable conductivity parameters which comprises (1) mixing carrier cores with a polymer mixture comprising from about 10 to about 90 percent by weight of a first polymer, and from about 90 to about 10 percent by weight of a second polymer; (2) dry mixing the carrier core particles and the polymer mixture for a sufficient period of time enabling the polymer mixture to adhere to the carrier core particles; (3) heating the mixture of carrier core particles and polymer mixture to a temperature of between about 200° F. and about 550° F. whereby the polymer mixture melts and fuses to the carrier core particles; and (4) thereafter cooling the resulting coated carrier particles.

Also, while the size of the carrier particles can vary, generally they are of a diameter of from about 50 microns to about 500 microns, thus allowing these particles to possess sufficient density and inertia to avoid adherence to the electrostatic images during the development process. The carrier particles can be mixed with the toner particles in various suitable combinations, such as for example from about 1 to about 10 parts per toner to about 100 parts by weight of carrier are mixed.

The toner compositions of the present invention can be prepared by a number of known methods, including mechanical blending and melt blending the toner resin particles, pigment particles or colorants, and polyethylene followed by mechanical attrition and classification to provide toner particles with an average diameter of from about 7 to about 20 microns.

The toner and developer compositions of the present invention may be selected for use in developing images in electrostatographic imaging systems containing therein, for example, conventional photoreceptors, such as selenium and selenium alloys. Also useful, especially wherein there are selected positively charged toner compositions, are layered photoresponsive devices comprised of transport layers and photogenerating layers, reference U.S. Pat. Nos. 4,265,990; 4,585,884; 4,584,253 and 4,563,408, the disclosures of which are totally incorporated herein by reference, and other similar layered photoresponsive devices. Examples of photogenerating layers include selenium, selenium alloys, trigonal selenium, metal phthalocyanines, metal free phthalocyanines and vanadyl phthalocyanines, while examples of charge transport layers include the aryl amines as disclosed in U.S. Pat. No. 4,265,990.

The toner and developer compositions of the present invention are particularly useful with electrostatographic imaging apparatuses containing a development zone situated between a charge transporting means and a metering charging means, which apparatus is illustrated in U.S. Pat. Nos. 4,394,429 and 4,368,970. More specifically, there is illustrated in the aforementioned '429 patent a self-agitated, two-component, insulative development process and apparatus wherein toner is made continuously available immediately adjacent to a flexible deflected imaging surface, and toner particles transfer from one layer of carrier particles to another layer of carrier particles in a development zone. In one embodiment, this is accomplished by bringing a transporting member, such as a development roller, and a tensioned deflected flexible imaging member into close proximity, that is a distance of from about 0.05 millimeter to about 1.5 millimeters, and preferably from about 0.4 millimeter to about 1.0 millimeter in the present of a high electric field, and causing such members to move at relative speeds. There is illustrated in the aforementioned '970 patent an electrostatographic imaging apparatus comprised of an imaging means, a charging means, an exposure means, a development means, and a fixing means; the improvement residing in the development means comprising in operative relationship a tensioned deflected flexible imaging means, a transporting means, a development zone situated between the imaging means and the transporting means, the development zone containing therein electrically insulating magnetic carrier particles, means for causing the flexible imaging means to move at a speed of from about 5 centimeters/-second to about 50 centimeters/second, means for causing the transporting means to move at a speed of from about 6 centimeters/second to about 100 centimeters/-second, the means for imaging and the means for transporting moving at different speeds, and the means for imaging and the means for transporting having a distance therebetween of from about 0.05 millimeter to about 1.5 millimeters.

In an embodiment, the present invention relates to a process for the preparation of a toner with a melting point of from about 100° to about 130° C. which comprises the addition of a linear crystalline polyethylene with a weight average molecular weight of from about 500 to about 1,200 to a toner comprised of a polyester and pigment.

The following examples are being submitted to further define various species of the present invention. These examples are intended to illustrate and not limit the scope of the present invention. Also, parts and percentages are by weight unless otherwise indicated.

EXAMPLE I

There was prepared by melt blending in a Banbury/-Rubber Mill, followed by mechanical attrition in a Fitzmill, followed by air jet attrition, a toner composition comprised of 71 percent by weight of the linear polyester propoxilated bisphenol fumerate resin, 28 weight percent of acicular magnetite MO4232 obtained from Pfizer Company and 1 percent by weight of the charge enhancing additive distearyl dimethyl ammonium methyl sulfate. Subsequently, there was prepared a developer composition by admixing the aforementioned formulated toner composition at a 4.5 percent toner concentration, that is 4.0 parts by weight of toner per 100 parts by weight of carrier, which carrier was comprised of a steel core with a coating, 1.25 weight percent, thereover of a vinyl chloride trichlorofluoroethylene copolymer with carbon black particles dispersed therein.

Thereafter, the formulated developer composition was incorporated into an electrostatographic imaging device with a toner transporting means, a toner metering charging means, and a development zone as illustrated in U.S. Pat. No. 4,394,429; and wherein the imaging member was comprised of an aluminum supporting substrate, a photogenerating layer of trigonal selenium, and a charge transport layer thereover of the aryl amine N,N'-diphenyl-N,N'-bis(3-methylphenyl)-1,1'-biphenyl-4,4'-diamine, 50 percent by weight, dispersed in 50 percent by weight of the polycarbonate resin available as MAKROLON®, reference U.S. Pat. No. 4,265,990, the disclosure of which is totally incorporated herein by reference.

Images were generated and fused at 295° F. with a VITON TM fuser roll, and the image mass measured by weighing was 1.4 milligrams/cm$^2$ and the oiling rate, that is the amount of silicone oil consumed, was 10 microliters per copy. After 15 minutes of operating the fuser roll at 2 inches per second, the toner evidenced substantial offset fuser roll contamination as evidenced by visual observation, resulting in fuser failure, that is the fuser roll could not be reused unless the toner thereon was manually removed from the fuser roll.

EXAMPLE II

A toner and developer composition was prepared by repeating the procedure of Example I with the exceptions that there was selected 67 weight percent of the polyester and there was added 4 weight percent of the polyethylene POLYWAX 1,000 TM obtained from Petrolite Corporation with an average molecular weight of about 1,000.

The prepared developer composition was then incorporated into the same electrostatographic imaging device of Example I, and there resulted images of excellent quality, for example, with no fuser roll offset to paper as determined by visual observation, or no fuser roll contamination as determined by visual observation after operating the fuser for 5.5 hours with the silicone oil rate being 6.3 microliters per copy, followed by ½ hour of fuser roll operation wherein the fuser oil rate was 2.3 microliters per copy. No toner offset was observed during the aforementioned fusing. The presence of the POLYWAX 1,000 TM provided enhanced release characteristics for the Viton fuser roll which enabled the fusing of the toner with the polyester at 295° F.

EXAMPLE III

A toner and developer composition was prepared by repeating the procedure of Example I with the exceptions that there was selected a Xerox Corporation 5028 TM silicone fuser roll operating at a speed of 3 inches per second and no release oil was utilized. The fusing latitude as visually observed between minimum fix as measured by crease area and hot offset was 30° F.

EXAMPLE IV

A toner and developer composition was prepared by repeating the procedure of Example II with the exception that there was selected the silicone fuser roll operating at a speed of 3 inches per second and no release oil was utilized. The fusing latitude visually observed between minimum fix as measured by crease area and and hot offset was 60° F., that is an increase of 30° F. in fuser temperature latitude as compared to the toner of Example III.

The melting point of the polyethylenes selected for the processes of the present invention are usually equal to, or less than the temperature where there is significant flow of the toner particles. The POLYWAX 1,000 TM is considered especially suitable since it is a low viscosity liquid which can diffuse to the toner/fuser interface, and provide excellent release characteristics.

Other modifications of the present invention may occur to those skilled in the art subsequent to a review of the present application. The aforementioned modifications, including equivalents thereof, are intended to be included within the scope of the present invention.

What is claimed is:

1. A process for avoiding toner offsetting and reducing the amount of fuser release oil selected in a xerographic imaging apparatus consisting essentially of adding to said xerographic imaging apparatus containing a layered imaging member a toner with a melting point of from about 100 to about 130° C., which toner consists essentially of a linear polyester, pigment and a charge enhancing additive, and an added linear crystalline polyethylene with a weight average molecular weight of from about 500 to about 1,000, thereby enabling the toner particles to be substantially completely released from a fuser roll present in said xerographic imaging apparatus and wherein the amount of fuser release oil utilized is reduced from about 20 to about 50 microliters for each developed image copy to about 2 to about 3 microliters for each developed image copy.

2. A process in accordance with claim 1 wherein the polyethylene has a molecular weight of 1,000.

3. A process in accordance with claim 2 wherein the crystalline polyethylene is uniformly dispersed in the toner composition.

4. A process in accordance with claim 1 wherein the polyester is a propoxilated bisphenol fumerate, cyclohexanol bisphenol terephthalate, or propylene butylene terephthalate.

5. A process in accordance with claim 4 wherein the crystalline polyethylene has a molecular weight average of about 1,000.

6. A process in accordance with claim 1 wherein the crystalline polyethylene is present in an amount of from about 1 to about 10 weight percent.

7. A process in accordance with claim 1 wherein the addition of the linear crystalline polyethylene is accomplished with mixing, and thereafter the mixture is heated and cooled.

8. A process in accordance with claim 1 wherein the melting point of the toner is 125° C.

9. A process in accordance with claim 1 wherein toner offsetting is avoided during image fusing.

10. A process in accordance with claim 1 wherein the pigment is carbon black, magnetite, or mixtures thereof.

11. A process in accordance with claim 1 wherein the pigment is cyan, magenta, yellow, or mixtures thereof.

12. A process in accordance with claim 1 wherein the pigment is red, blue, green, brown, or mixtures thereof.

13. A process in accordance with claim 1 wherein the toner obtained is subjected to micronization and classification prior to being introduced into said xerographic imaging apparatus.

14. A process in accordance with claim 1 wherein the toner is subjected to grinding, micronization, and classification.

15. A process in accordance with claim 1 wherein there results developed images of excellent quality with no fuser roll offset to paper or no fuser roll contamination subsequent to operating the fuser for about 5 hours followed by operation of the fuser roll for about an additional half hour.

16. A process in accordance with claim 15 wherein the toner selected contains about 71 percent by weight of said linear polyester, 28 weight percent of the pigment magnetite, and 1 weight percent of the charge enhancing additive.

* * * * *